United States Patent [19]

Tissot

[11] 4,068,466

[45] Jan. 17, 1978

[54] COUPLING DEVICE OF THE BACK-COVER AND THE MIDDLE OF A WATERPROOF SHAPED WATCH-CASE

[75] Inventor: Lucien Tissot, La Chaux-de-Fonds, Switzerland

[73] Assignee: Jean-Louis Kernen, La Chaux-de-Fonds, Switzerland

[21] Appl. No.: 665,334

[22] Filed: Mar. 9, 1976

[30] Foreign Application Priority Data

Mar. 11, 1975 Switzerland ..... 3044/75

[51] Int. Cl.[2] ..... G04B 37/08

[52] U.S. Cl. ..... 58/90 R; 58/53; 58/55; 58/88 R

[58] Field of Search ..... 58/53–55, 58/88 R, 90 R, 90

[56] References Cited

U.S. PATENT DOCUMENTS

| | | | |
|---|---|---|---|
| 2,737,010 | 3/1956 | Piauerez | 58/90 R |
| 3,608,304 | 9/1971 | Schaad | 58/90 R |

FOREIGN PATENT DOCUMENTS

| | | | |
|---|---|---|---|
| 208,781 | 9/1940 | Switzerland | 58/90 R |
| 343,943 | 2/1960 | Switzerland | 58/90 A |

*Primary Examiner*—E. S. Jackmon
*Attorney, Agent, or Firm*—Young & Thompson

[57] ABSTRACT

This invention relates to a bayonet-type coupling device of the back-cover and the middle of a waterproof shaped watch-case, in which said middle presents a hollow comprising an annular groove in its internal wall and said back-cover comprises a cylindrical or prismatic annular wall provided with at least two ledges, and in which the sizes of said annular wall and of said hollow are such that, for at least an angular position of the back-cover with regard to the middle, they are free, the annular wall of the back-cover being placed within the hollow of the middle, and that, for at least another angular position, they are coupled by engagement of at least a part of the ledges in the annular groove, characterized by the fact that said angular coupling position is defined by the contact of a part of the external surface of the annular wall of the back-cover with the internal surface of the hollow, both these surfaces having the same shape and the same sizes, so that the external surfaces of the middle and of the back-cover are in coincidence. The external surface of the annular wall of the back-cover comprises at least an edge, constituting a locking strong point, cooperating with the internal surface of the hollow in order to lock the back-cover and the middle in their coupling angular position. There is a watertight joint between the middle and the back-cover that encircles the annular wall of said back-cover.

9 Claims, 3 Drawing Figures

COUPLING DEVICE OF THE BACK-COVER AND THE MIDDLE OF A WATERPROOF SHAPED WATCH-CASE

The present invention relates to a bayonet-type coupling device of the back-cover and the middle of a waterproof shaped watch-case, in which said middle presents a hollow comprising an annular groove in its internal wall and said back-cover comprises a cylindrical or prismatic annular wall provided with at least two ledges, and in which the sizes of said annular wall and of said hollow are such that, for at least an angular position of the back-cover with regard to the middle, they are free, the annular wall of the back-cover being placed within the hollow of the middle, and that, for at least another angular position, they are coupled by engagement of at least a part of the ledges in the annular groove.

It is known to provide as coupling devices of the back-cover and the middle of a waterproof shaped watch-case, especially bayonet fittings as well as oblique ramps fastenings. The bayonet fitting per se is not particularly suitable for shaped watch-cases, because it requires elements to be encased having circular bearing surfaces. The device with oblique ramps acts by jamming and involves an axial movement for the coupling; this leads to the use of elements with relatively wide bearing surfaces and thereby precludes the manufacture of flat waterproof cases.

It is also known from Swiss Patent No. 488,220 to provide a waterproof shaped watch-case, the back-cover of which comprises axial ledges provided with catching means cooperating with coacting catching means which the external middle of the case is provided with. The coupling, presenting a certain analogy with a bayonet device, is achieved by a rotative movement of the back-cover which is maintained centrally adjusted by an element of the case. The practical realization of this invention presents several disadvantages among which can be mentioned the following: the necessity of having an internal intermediate middle-case used for guiding in rotation the back-cover and of having separated locking means, for example a screw, in order to hinder the undesired rotation of said back-cover; the poor watertightness between the back-cover and the internal wall of the external middle-case; and the difficult and delicate machining of the pieces in order to obtain the coincidence of the external surfaces in service position and in circular guiding position.

Consequently, the object of this invention is to provide a bayonet-type coupling device of the back-cover and the middle of a waterproof shaped watch-case of the aforementioned type and obviating the disadvantages of the known realizations, characterized by the fact that said angular coupling position is defined by the contact of a part of the external surface of the annular wall of the back-cover with the internal surface of the hollow, both these surfaces having the same shape and the same sizes, so that the external surfaces of the middle and of the back-cover are in coincidence; by the fact that the external surface of the annular wall of the back-cover comprises at least an edge, constituting a locking strong point, cooperating with the internal surface of the hollow in order to lock the back-cover and the middle in their coupling angular position; and by the fact that a watertight joint is provided between the middle and the back-cover and encircles the annular wall of said back-cover.

The annexed drawing illustrates schematically and by way of example one embodiment of the coupling device according to the invention.

Figure 1:
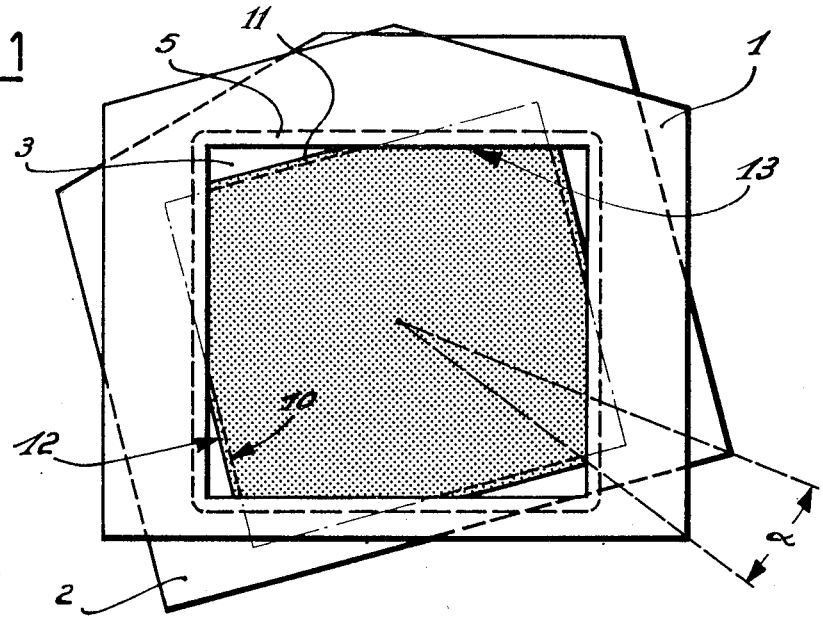
FIG. 1 is a top plan view thereof, in the free angular position.

The embodiment described by way of example represents a waterproof watch-case having a pentagonal external shape and comprising a middle 1 and a back-cover 2.

The middle 1 comprises a hollow 3, having a rectangular shape and being delimited by an internal wall 4. This wall 4 is provided with a continuous groove 5 parallel and close to the lower peripheral end 6 of said middle 1; this end 6 comprises further on its frontal face a peripheral groove 7, intended for receiving a waterproof compressible gasket 8.

The back-cover 2 comprises a polygonal wall 9, the section of which comprises external rectilinear portions 10 which are inscribed in a shape identical to and having the same size as that of the hollow 3, and having the same axis as the external shape of the back-cover 2; these rectilinear portions 10 are surmounted with projecting ledges 11, which comprise external rectilinear portions 12 inscribed in a shape identical with that of the hollow 3 and having the same axis as the external shape of the back-cover 2, but having larger sizes than those of hollow 3 and smaller sizes than those of groove 5. The wall 9 is further provided with external rectilinear portions 13, which are inscribed in a shape identical with that of hollow 3, but having slightly smaller sizes than said hollow, said shape being further shifted of an angle $\alpha$, for example about 15°, with respect to the external shape of the back-cover 2 and to the shapes in which the rectilinear portions 10 and 12 are inscribed. Furthermore, each intersection (for example 4) between portions respectively 10 and 13 of the wall 9 forms on said wall an edge 14 constituting each a locking strong point.

The general shape of the internal surface of the hollow 3, and thereby of the shapes in which the portions 10 and 12 of annular wall 9 and the portions 12 of the ledges 11 are inscribed, may be polygonal, with rounded or not angles and with curved or not sides, elliptical, oval, or of any other shape. The number of ledges 11 is determined by the general shape of the cylindrical or prismatic annular wall 9; this number is at least 2 for oval or elliptical shapes, and is equal to the number of sides for the polygonal shapes.

The general external shape of the watch-case, identical to or different from that of the internal surface of the hollow, may also be polygonal, oval, elliptical, or of any other shape.

In order to couple the two parts of the shaped watch-case, the back-cover 2 is introduced into the middle-case 1, so that the external shapes of both pieces are shifted of the angle $\alpha$, this corresponding to the free disengaged position (see FIG. 1).

The back-up cover 2 is then displaced angularly with respect to the middle 1, so that the ledges 11 are engaged in the groove 5. After having passed over the strong point constituted by the edges 14, the amplitude of the rotation movement is limited by the content between the rectilinear portions 10 of the wall 9 and the internal wall 4 of the hollow 3, which have exactly the same shape and the same sizes.

Figure 2:
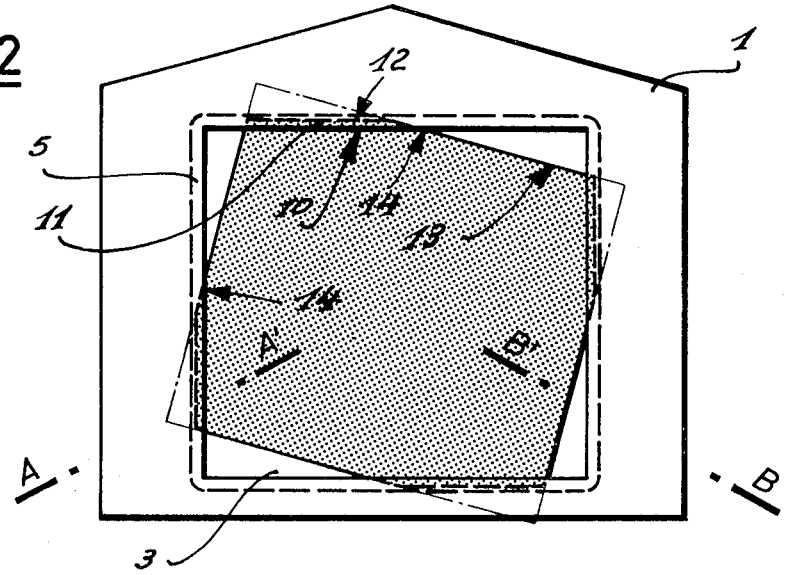
FIG. 2 is a top plan view thereof, in the coupled angular position.

In the as defined coupling position, as shown in FIG. 2, the external shapes of the back-cover 2 and of the middle-case 1 coincide.

The locking in coupled position of the coupling device according to the invention is therefore obtained by the fact that the edges 14 abut against the internal wall 4 of the hollow 3, as soon as there is an angular displacement of the pieces the one with respect to the other.

Figure 3:
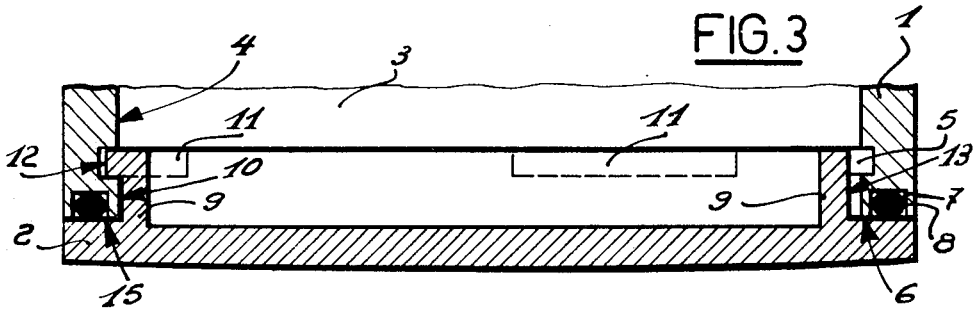
FIG. 3 is a cross-section view on lines AA' and BB' of FIG. 2.

As shown in FIG. 3, the coupling is further made waterproof by compressing the gasket 8 against the frontal surface 15 of the back-cover 2; this waterproof gasket may be, in another unillustrated embodiment, lodged in a peripheral groove of said surface 15 of the back-cover 2.

The back-cover 2 may be further provided with means (not shown) intended to facilitate the rotary movement for locking or unlocking the coupling with the middle-case 1, that is for passing, in one direction or in the other, over the strong points constituted by the edges 14; for example said means could be slots provided near the periphery of said back-cover and which are intended to cooperate with an appropriate wrench.

The coupling device of the back-cover and the middle of a waterproof shaped watch-case according to the invention presents, in comparison with the known devices, the following advantages:

its design, manufacture and use are easy and efficacious;
it is of minimal sizes and allows one therefore to realize flat and waterproof shaped watch-cases;
the coupling in coincidence of the shaped back-cover with the shaped middle-case is easy to obtain;
it does not require the use of separate locking means (screw, etc.);
the rotation angle for passing from the free disengaged position over to the locked coupled service position is small; and
the matching of the pieces to be coupled may be carried out in only one step, this leading to the reduction of the duration and the costs of the manufacture.

What we claim is:

1. A bayonet-type coupling device of the back-cover and the middle of a waterproof shaped watch-case, in which said middle presents a hollow comprising a groove in its internal wall and said back-cover comprises a wall provided with at least two outwardly extending ledges, and in which the sizes of said wall and of said hollow are such that, for at least an angular position of the back-cover with regard to the middle, they are free, the wall of the back-cover being placed within the hollow of the middle, and that, for at least another angular position, they are coupled by engagement of at least a part of the ledges in the groove, characterized by the fact that said angular coupling position is defined by the contact of a part of the external surface of the wall of the back-cover with the internal surface of the hollow, both these surfaces having the same shape and the same sizes, so that the external surfaces of the middle and of the back-cover are in coincidence; by the fact that the external surface of the wall of the back-cover comprises at least an edge, constituting a locking strong point, cooperating with the internal surface of the hollow in order to lock the back-cover and the middle in their coupling angular position; and by the fact that a watertight joint is disposed between the middle and the back-cover and surrounds the wall of said back-cover.

2. A coupling device according to claim 1, characterized by the fact that said hollow is of polygonal shape.

3. A coupling device according to claim 1, characterized by the fact that said hollow is of oval or elliptical shape.

4. A coupling device according to claim 1, characterized by the fact that said watertight joint is disposed in a peripheral groove of the back-cover.

5. A coupling device according to claim 1, characterized by the fact that said watertight joint is disposed in a peripheral groove of the middle-case.

6. A coupling device according to claim 1, characterized by the fact that said back-cover has a base, that said wall is upstanding from said base and terminates along its upper edge in said outwardly extending ledges, said external surface of said middle being disposed between said ledges and said base of said back-cover, said internal surface of said hollow being disposed between said groove and an end of said middle.

7. A coupling device according to claim 6, characterized by the fact that said base of said back-cover extends edgewise outwardly beyond said wall, said joint being disposed between said end of said middle and the edgewise outwardly extending portion of said base of said back-cover.

8. A coupling device according to claim 6, characterized by the fact that the outer edges of said ledges are spaced inwardly from the bottom of said groove in said coupling angular position.

9. A coupling device according to claim 2, in which said wall is polygonal and has twice the number of sides as said hollow, said ledges being disposed on alternate sides of said wall.

* * * * *